United States Patent [19]

Headon

[11] Patent Number: 4,567,981

[45] Date of Patent: Feb. 4, 1986

[54] DISPLAY PACKAGING SYSTEM

[75] Inventor: Randall G. Headon, Willowdale, Canada

[73] Assignee: CDA Industries Inc., Scarborough, Canada

[21] Appl. No.: 640,046

[22] Filed: Aug. 10, 1984

[51] Int. Cl.[4] ..... B65D 5/50; B65D 73/00

[52] U.S. Cl. ..... 206/45.14; 206/45.19; 206/597; 206/821; 206/486; 206/429; 206/432; 206/433

[58] Field of Search ..... 206/597, 821, 45.14, 206/45.19, 501, 486, 490, 432, 433, 429

[56] References Cited

U.S. PATENT DOCUMENTS

| | | | |
|---|---|---|---|
| 3,168,192 | 2/1965 | Nicholson et al. | 206/45.28 |
| 3,473,654 | 10/1969 | Zimmerman | 206/597 |
| 3,659,707 | 5/1972 | Nilsson et al. | 206/597 |
| 3,904,030 | 9/1975 | Repp et al. | 206/821 |
| 4,036,364 | 7/1977 | Ambrose | 206/597 |
| 4,098,400 | 7/1978 | Brown | 206/821 |
| 4,195,732 | 4/1980 | Bell | 206/597 |
| 4,303,157 | 12/1981 | Edwards | 206/821 |

*Primary Examiner*—Joseph Man-Fu Moy

*Attorney, Agent, or Firm*—George A. Rolston

[57] ABSTRACT

A stack display system, for use in association with a multiplicity of essentially similar, essentially rigid products, the stack display packaging system comprising, a support platform, defining a front, back and sides of the display, at least one layer of product and product packaging, each layer comprising a lower support, adapted to be supported by one of a group consisting of the support platform and a lower layer, product bottom receiving forming part of the lower support adapted to receive and support bottoms of the products in a predetermined relationship to each other, and a plurality of products the bottoms of which are received in the product bottom receiving, and enclosure around the back and at least part of the sides of the layers, extending vertically from a lowermost lower support.

21 Claims, 5 Drawing Figures

FIG.1.
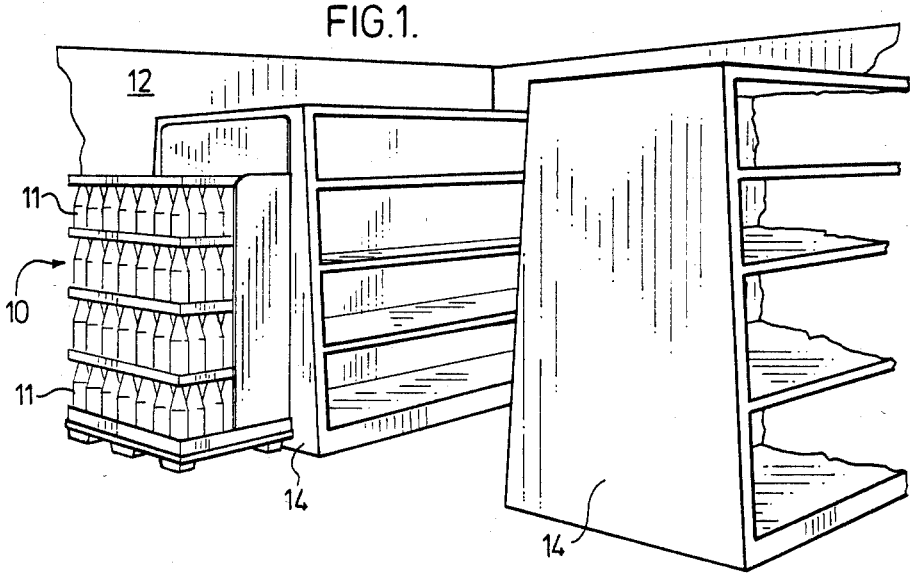
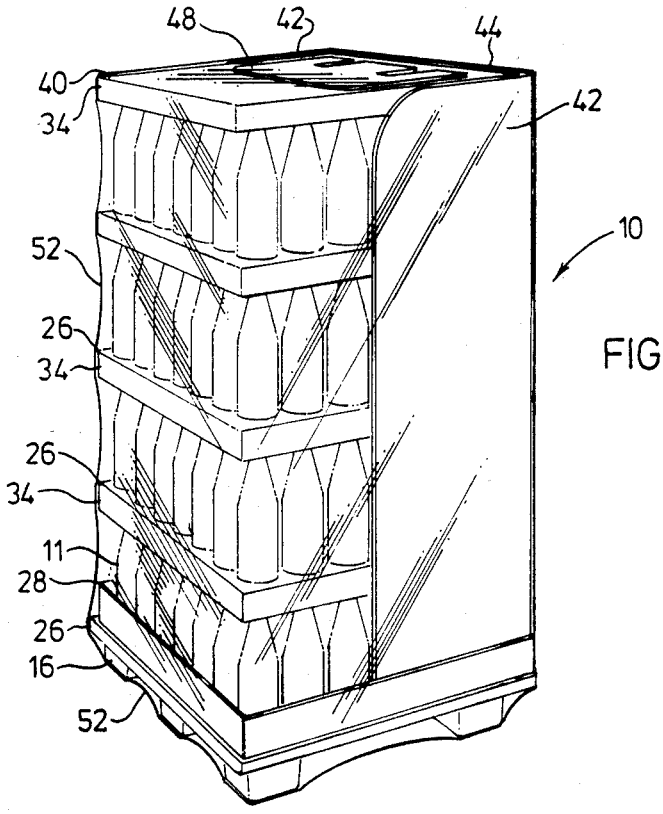
FIG. 3.

DISPLAY PACKAGING SYSTEM

NATURE OF THE INVENTION

The invention relates to a display packaging system for the distribution and sale of a multiplicity of containers, within which product may be contained. In particular, the invention relates to a display packaging system for bottles, cans and the like.

BACKGROUND OF THE INVENTION

In any retail sales operation, it is necessary that the product to be sold be conveniently stored and displayed for easy access. In a self-service retail sales outlet, the consumer must be attracted to the product display. He must then be able to easily identify the product and determine whether sufficient quantities of the product are available to satisfy his needs. All necessary information, such as brand name and logo, price, price per unit, quantity of product, a special price (if any), ingredients information and the like, must be conveniently displayed in order to allow the consumer to determine whether to buy the product. The consumer must then be able to easily and safely remove the product, as required, from the display. Minimal or no assistance from store personnel should be required.

The above requirements for a retail sales operation generally apply to any product; however, in particular, they apply to product stored in bottles, cans and the like.

A typical method of displaying, for example, cans, requires the removal of the cans from the cardboard boxes in which they are transported. Subsequently the cans are stacked into attractive pyramid-like piles located in aisles or other available space. Prices and other information relating to the product may be provided on a nearby sign. Such a system suffers from numerous disadvantages. First, a significant amount of labour is required to arrange the display initially. Second, once arranged, it cannot be easily moved. A move would entail a further amount of labour. Third, not all consumers may be able to conveniently reach and remove a can from the top of the stack. Fourth, a consumer may remove a can from the middle of the stack, introducing structural instability to the stack. The stack in such a condition is unsafe and may collapse unexpectedly. Such a collapse may cause personal injury and loss of product if cans are damaged. Sales of other products may be interfered with and, at the very least, additional labour will be required to clean up and reorganize the cans.

Another typical method for display involves the removal of cans from the cardboard boxes and their storage on shelves, usually in close association with other, sometimes competing, products. In addition to the above disadvantages, the product display may not be pleasing or attractive to the consumer's eye. As well, shelf space is required and such requirement may limit the kinds or amounts of product that the store operator may be able to display and sell. Similar problems arise if the product containers are stored in bins.

Generally, product in containers (such as bottles, cans and the like) is shipped from a manufacturer's plant in cardboard or plastic boxes. At the retail store, another common display method comprises the stacking of opened boxes. In the case of cardboard boxes, a sharp knife is used to cut away the top part of the box, leaving only a tray-like bottom portion in which the product is stored. Cardboard inserts between adjacent containers, which provide padding, are removed. A second box, opened in a similar way, may be stacked directly on top of the first box. In this way, the upper box rests on and is supported by the containers in the lower box. In such a system, less labour is required for setting up than in the case of the other displays described above. This system provides what is essentially a stack of product, without in-store shelving. The layers of product are supported on each other.

This is suitable for products such as cans, where the product has a uniform shape, top and bottom It is much less suitable for products such as bottles where the top is small, in relation to the bottom. Bottles may be displaced or tilted and thus render the stack unstable. Bottles are usually taller than cans, giving rise to greater problems of instability. Another important disadvantage with this system is that a consumer may remove product from a lower box/tray. If a can is removed from other than the upper box/tray, the stack may become unstable with the consequent danger of collapse. A further disadvantage is that typical cardboard boxes do not provide an attractive display for consumers.

In the case of plastic boxes, the upper face of each box is often open. An upper box may rest on and be supported by a lower box. In this case a consumer is effectively prevented from removing product from a lower box prior to removal of the upper box. However, there exists the disadvantage that when the upper box is empty, the next consumer will have to remove the bulky, perhaps heavy, plastic upper box to gain access to the lower box.

In light of the foregoing disadvantages, clearly it would be advantageous to provide a combined stacking and display system for containers which requires a minimal amount of labour to set up, is portable, is attractive, is safe, and prevents a consumer from removing containers from lower layers of the display.

In particular it is desirable to provide such a system which is particularly suitable to the stacking of bottles in a self-supporting display of this type.

STATEMENT OF THE INVENTION

The invention comprises a stack display packaging system, for use in association with a multiplicity of essentially similar, essentially rigid products, the stack display packaging system comprising: a support platform means, defining a front, back and sides of the display, at least one layer of product and product packaging, each layer comprising a lower support means, adapted to be supported by one of group consisting of the support platform means and a lower layer, product bottom receiving means forming part of said lower support means adapted to receive and support bottoms of the products in a pre-determined relationship to each other and a plurality of products, the bottoms of which are received in the product bottom receiving means, and, enclosure means around the back and at least part of the sides of the layers, extending vertically from a lowermost lower support means.

The advantages of the invention include the following:

The containers are packaged together into a portable stack display system at the manufacturer's plant. The display system also provides sufficient protection for the containers during transportation from the manufacturer's plant to the in-store sale site. Because the display system is organized by the manufacturer, the set up labour by store personnel is minimized. The display package is attractive, portable and safe. A consumer is unable to remove a container from a lower layer of the display. Thus a stack of product in the display remains stable and safe. When an upper layer of product is empty, it is easy and convenient for a consumer to have access to a next lower layer.

It is thus an object of the invention to provide an inexpensive, portable, attractive, safe and stable stack display system for containers.

It is a further object that such system may be organized by a manufacturer at its plant and that the display system provide sufficient protection to protect the containers during transportation from the plant to the in-store sale site.

It is a further object that such system be particularly advantageous for use with bottle containers.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a perspective schematic drawing of one embodiment of a display system according to the invention as it may be installed in-store;

FIG. 3 is a perspective drawing of the display system of FIG. 1, prior to installation in-store;

DESCRIPTION OF A SPECIFIC EMBODIMENT

Figure 2:
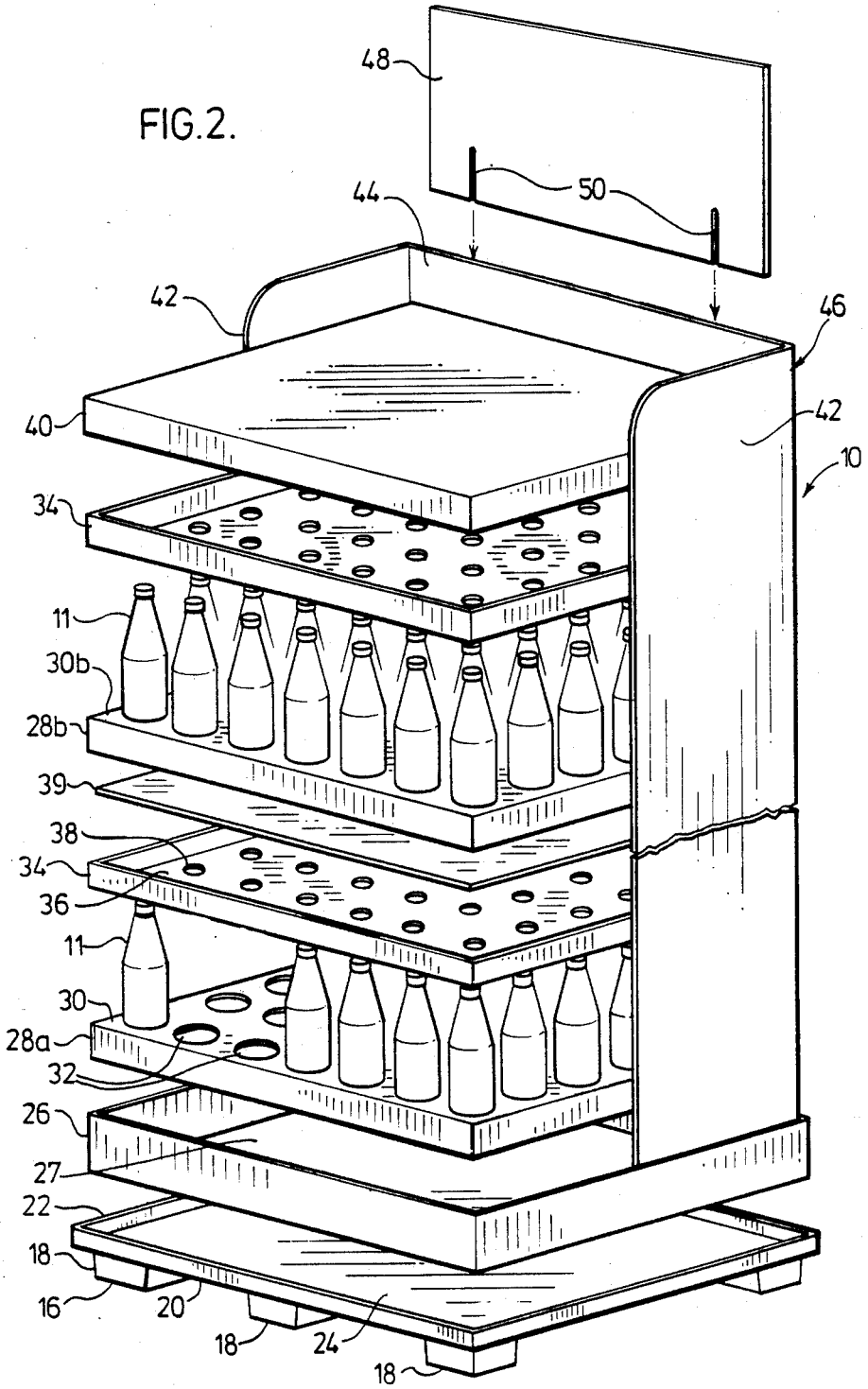
FIG. 2 is an expanded perspective drawing of the display system of FIG. 1.

Referring to FIG. 1, there is illustrated a display system 10, according to the invention, installed within retail store 12. Display 10 includes and displays for sale bottles 11. A bottle 11 typically defines a narrow neck portion and top and a widened base or bottom portion. Commonly, the bottom of a bottle may define a generally concave depression. Display 10 is shown located at the end of a shelf unit 14. However, display 10 is free standing and may be located anywhere within store 12 where there is sufficient space. Such location may be against a wall, in a corner, in an open area or elsewhere. Of course, more than one display system 10 may be used in a single store. Units 10 could be placed back to back, side to side, or in any other suitable arrangement. It is conceivable that, in certain applications, display systems 10 according to the invention may entirely replace shelf units 14.

Referring to FIG. 2, an expanded view of a display system 10, as installed, is provided. Display 10 includes a pallet 16, which acts as a base or support platform for display 10. Pallet 16 must have sufficient structural strength to support all of bottles 11 and other packaging structure, as described below. Accordingly, pallet 16 may be constructed out of thermoplastic, metal, wood or even heavy gauge cardboard or other suitable material.

Pallet 16 may include spacers 18 to raise display 10 off of the floor. The tines of a forklift truck or device may be inserted between spacers 18 in order to lift and move display 10. In the FIG. 2 embodiment, pallet 16 includes six spacers 18, organized into a front and a back row. Such an arrangement of spacers 18 is particularly convenient as it allows the tines of a forklift to be inserted along each side of pallet 16.

Pallet 16 defines a tray-like top 20 having a support surface 24 and a lip 22 therearound.

A shallow open base box 26 is adapted to fit within lip 22 on surface 24. Box 26 defines an open face portion which faces upwardly. Box 26 defines a box bottom 27.

A bottom insert **28*a* is provided to fit within box 26. Insert 28*a* essentially defines a shallow open box, having a side wall 29*a* and an open face portion directed downwardly. Insert 28*a* may have a depth approximately the same as or somewhat less than that of box 26. Insert 28*a* defines a top surface 30. Surface 30 defines holes 32, adapted to receive the bottom ends of bottles 11** in a convenient arrangement.

The bottom ends of bottles 11 are fitted within holes 30. Bottles 11 thus rest on box bottom 27 and are prevented from shifting horizontally with respect to each other by surface 30.

Top overlay 34 is adapted to fit over the tops of bottles 11. Top overlay 34 defines a shallow open box, having a side wall 35 and an open face portion directed upwardly, and a bottom surface 36. Bottom surface 36 defines holes 38 adapted to fit over the tops of bottles 11. Top overlay 34 may have a depth approximately the same as that of a bottom insert **28*a***.

The tops of bottles 11 are fitted within holes 38 and extend through bottom surface 36. Bottles 11 are thus prevented from shifting horizontally with respect to each other by bottom surface 36.

A cushioning pad 39 overlies the tops of bottles 11, for purposes to be described.

A second bottom insert **28*b* is provided to fit within the open box defined by top overlay 34. Bottom insert 28*b* may be essentially identical to bottom insert 28*a*, for convenient manufacture and assembly of display system 10. Bottom insert 28*b* defines a wall 29*b* and a top surface 30*b*. Cushioning pad 39 is adapted to fit within top overlay 34 and bottom insert 28*b***.

Bottom insert **28*b*, top overlay 34, pad 39 and bottles 11 cooperate with each other in such a way that the top surface 30*b* of insert 28*b* is vertically supported above pad 39 and that surface 30*b* is not free to move horizontally. To meet these requirements, insert 28*b* and overlay 34 nest with each other, one within the edges of the other. As shown in FIGS. 2 and 3, insert 28*b* nests within overlay 34. The walls 29*b* of the internally nested insert 28*b* are sufficiently high to suspend surface 30*b* above pad 39**.

A second layer of bottles 11 is placed within holes 32 of bottom insert **28*b*. Bottles 11 thus rest on cushioning pad 39. Pad 39 transmits the weight of the upper layers onto the tops of bottles 11 in the lower layer, which project above bottom surface 36 through holes 38 of top overlay 34. Pad 39 may flex to adapt somewhat to the concave depression, if any, in the bottoms of bottles 11**.

Further layers of bottles 11 and packaging may be added as desired, as described above.

Over an uppermost layer of bottles 11, a final top overlay 34 if fitted.

A cover 40 is provided to fit within the open box defined by uppermost top overlay 34. Cover 40 essentially defines a shallow open box, having an open face portion directed downwardly and a depth corresponding approximately to that of top overlay 34.

Side panels 42 and rear panel 44 are provided to add structural strength to display system 10 and to improve its appearance. Panels 42 and 44 may be fastened to each other at corners, or may be made integrally with each other and subsequently folded, to form an enclosure, indicated generally as 46. Enclosure 46 wraps around the layers of bottles 11 and other packaging. The bottom of enclosure 46 fits within box 26 between box 26 and bottom insert 28*a*. The top of enclosure 46 may conveniently be approximately flush with the top of cover 40.

Removable information panel 48 is removably affixed by suitable means to rear panel 44. Such means may, for example as shown in FIG. 1, include slits 50 defined in panel 48. Information panel 48 fits over rear panel 44 by inserting rear panel 44 within slits 50. Thus, part of information panel 48 is in front of rear panel 44 and part is behind. In this way, information panel 48 rests on top of rear panel 44.

Information, which may vary from time to time, is posted or printed on information panel 48. As the information (such as prices) changes, a manufacturer or product supplier may provide the store operator with a new panel with new information. The operator may simply remove and discard the old panel 48 and insert new panel 48.

All of the above—described packaging structure—namely box 26, bottom inserts 28, top overlays 34, cushioning pad 39, cover 40, side panels 42, rear panel 44 and information panel 48—may conveniently be constructed of cardboard, although other materials may be used.

Referring to FIG. 3, there is shown a display system, according to the invention, prior to installation in-store. At the manufacturer's plant pallet 16 is loaded with a complete charge of product in bottles 11 supported by box 26, bottom inserts 28, top overlays 34, cushioning pads 39, cover 40, side panels 42, and rear panel 44, arranged as described above. Information panel 48 is loosely placed in an obvious location in the display stack. In FIG. 3, it is shown lying on top of cover 40. The entire stack is then bound together by suitable means. Such binding means may conveniently be shrinkable plastic, such as heat sensitive polyethylene. A sheet or bag of such plastic may be placed around the entire display package and shrink wrapped tightly thereto, to form plactic envelope 52. The plastic may be transparent for easy identification of the contents of the display. The resulting envelope 52 binds the containers 11 and packaging together for ease of transportation to the in-store sale site.

In operation, the display is set up in the store, simply by cutting away and removing the plastic envelope 52. Information panel 48 is fitted into place. Cover 40 and uppermost top overlay 34 are removed and discarded. The display is then ready for consumer use with a minimal amount of store personnel labour. If the store operator subsequently desires to move the display, a forklift device may be used to simply pick up and move it to the new location. Without the plastic envelope 52 to bind the display together, a person may be required to steady the stack during the moving operation.

Consumers may easily identify the product which is offered for sale in the display by direct observation of bottles 11 or from information printed on panel 48, or side or rear panels 42 or 44. All necessary information is provided so that the consumer may decide whether to purchase the product without enlisting the aid of store personnel. Having decided to purchase, the consumer may simply remove the required number of bottles 11 from the uppermost layer. The consumer cannot remove a bottle 11 from a lower layer because bottles 11 are locked in place by a bottom insert 26 and a top overlay 34. Thus, the display 10 cannot become unstable and it remains safe. If the uppermost layer has no more bottles, because a previous consumer has removed the last remaining bottle 11 on that layer, the consumer may simply remove the exposed light-weight cardboard bottom insert 26, pad 39, and top overlay 34. The consumer then has access to the next layer of bottles 11, which layer now becomes the new uppermost layer.

It will, of course, be appreciated that in different embodiments of the invention different sizes and shapes of displays may be used. Different displays may have different numbers of layers. The precise design of the bottom inserts and top overlays will depend on the size and shape of the containers to be displayed.

In another embodiment of the invention, the display may be held together by straps wrapped around it, rather than by the shrink wrapped plastic.

In a further embodiment of the invention, the containers may be entirely supported by and between the bottom inserts and top overlays. Holes therein may not be necessary. Indentations may suffice, as long as the weight of the upper layer is transmitted essentially directly through the material to the layer below. Thus, containers in one layer may not come into actual contact with containers in another layer.

Figure 4:
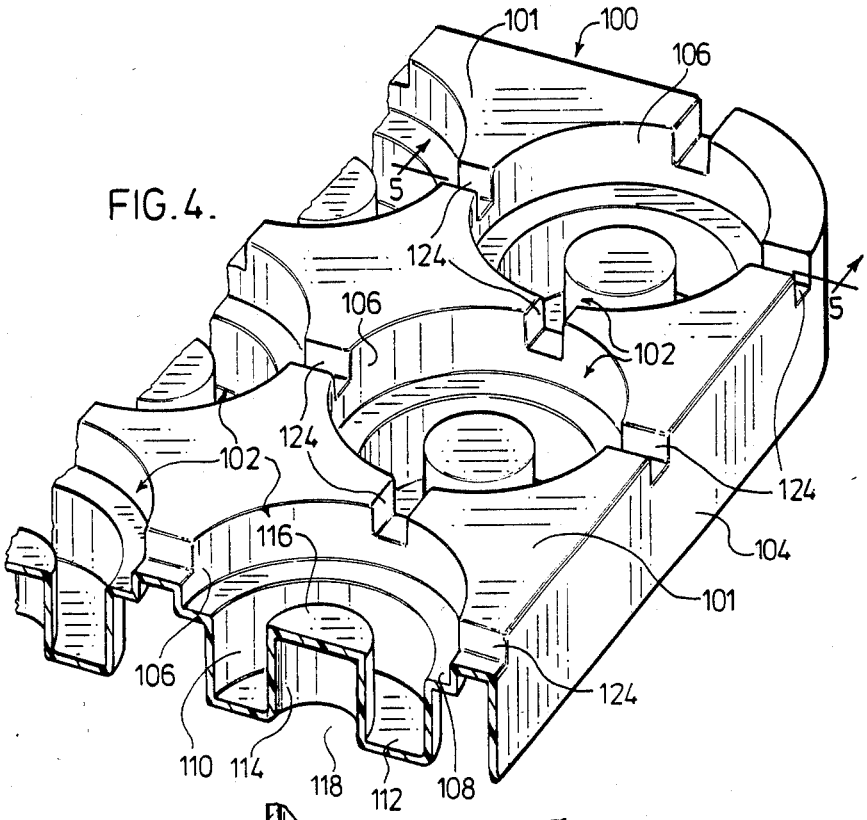
FIG. 4 is a perspective view of a portion of interlayer support, partially in section, as may be used in an alternate embodiment of the invention; and, FIG. 5 is a section along the line 5—5 of FIG. 4, with bottles in place.
Figure 5:
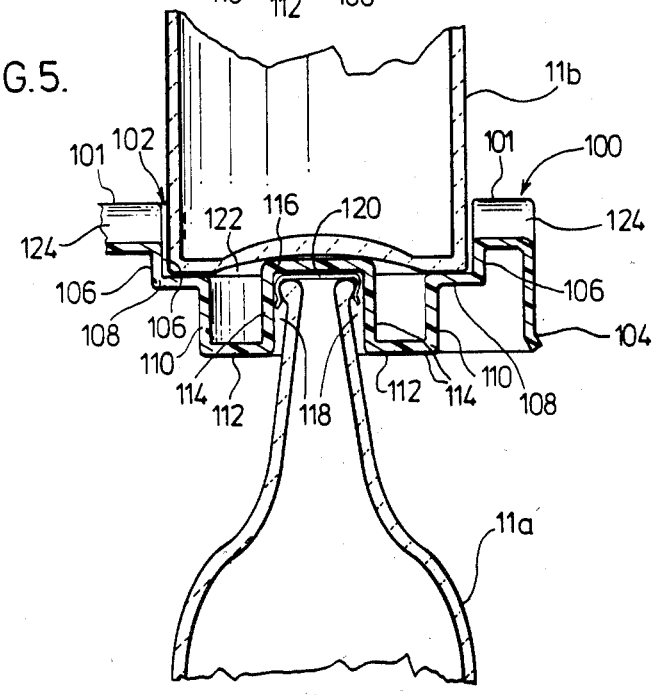

An inter-layer support 100 for such a further embodiment is illustrated in FIGS. 4 and 5. Certain advantages, such as cost, may be provided by using an inter-layer support comprised of a single component. Such an inter-layer support could be effectively used as a substitute for the base box 26/bottom insert 28*a* combination, the top overlay 34/cushioning pad 39/bottom insert 28*b* combinations, and the top overlay 34/cover 40 combinations used in the FIGS. 2 and 3 embodiment.

Inter-layer support 100 defines a flat upper surface 101, generally rectangular in shape when viewed in plan. Defined therein are a plurality of generally identical cup-like recesses, indicated generally as 102. Recesses 102 are arranged in rows and columns adapted to receive and support lower bottles 11*a* and upper bottles 11*b*. Recesses 102 define a shape suitable for receiving bottles 11. In the illustrated embodiment, such a shape is a circle corresponding to the circular cross-section of typical bottles 11. Other shapes may be used corresponding to the shapes of the bottles or containers to be displayed. Depending downwardly from the edges of rectangular surface 101 are side walls 104, which may meet and connect together at corners.

A recess 102 is defined by suitable surfaces, as described below, connected to flat surface 101. In particular, depending downwardly from upper surface 101 is circular outer wall 106. At a pre-determined depth below surface 101, outer wall 106 joins to a generally horizontal ledge 108. In the illustrated embodiment, in plan ledge 108 defines a circular ring. Ledge 108 is adapted to receive and support upper bottle 11*b* with a nominal clearance between the side walls of bottle 11*b* and outer wall 106.

From the inner edge of ledge 108, a circular inner wall 110 depends downwardly. At a pre-determined depth below ledge 108, inner wall 110 joins to a generally horizontal bottom surface 112. The central portion of bottom surface 112 defines a generally upwardly extending circular top receiving wall 114. Top receiving wall 114 extends upwardly a pre-determined distance, as described below. The upper portion of wall 114 is joined together by a generally horizontal circular cap wall 116.

Top receiving wall 114 and cap wall 116 define a downwardly oriented top receiving recess 118, adapted to receive the top portion of lower bottles 11*a*. A nominal clearance is defined between either the side walls of a bottle 11*a* or the edges of a bottle cap 120 on the top of bottle 11 and the top receiving wall 114.

Top receiving wall 114 and cap wall 116 extend upwardly a sufficient amount to contact and support the bottom central part of upper bottle 11*b*. Thus, the top receiving wall 114 and cap wall 116 may extend upwardly past ledge 108 into concave recess 122 defined in the bottom of bottle 11*b* to contact the bottom of bottle 11*b*. Of course, if bottle 11*b* defines a flat bottom, then cap wall 116 will be level with ledge 108.

Inter-layer support 100 may be conveniently manufactured of vacuum formed plastic. Such material will provide the benefits of ease and low cost of manufacture, durability, strength, shock absorbing ability and the possibility for repeated re-use of a support 100. For ease of manufacture, upper surface 100 defines air channels 124, connecting between adjacent recesses 102 and between recesses 102 which are adjacent to a side wall 104 and such side wall 104.

For convenient assembly in a display system 10, side walls 104 may extend downwardly to the same level as bottom surface 112.

In operation, in a display system 10, a first inter-layer support 100 is placed directly on pallet 16 within lip 22. Bottles 11 are placed in recesses 102, supported on ledges 108 and cap wall 116. A second inter-layer support 100 is then placed so that the tops of bottles 11 are inserted within recesses 118. Further layers of bottles 11 and supports 100 are stacked in like fashion. On top of the uppermost layer of bottles an uppermost support 100 is placed. Uppermost support 100 prevents relative movement amongst the bottles of the uppermost layer, but acts also as a cover for the display. An enclosure 46, comprised of side panels 42 and rear panel 44 is fitted around the layers of bottles 11 and supports 100. Enclosure 46 fits between lowermost support 100 and lip 22 of pallet 16, but is otherwise similar to the enclosure 46 of the FIGS. 2 and 3 embodiment. An information panel 48 is also provided as in the FIGS. 2 and 3 embodiment. The display stack is shrink-wrapped in plastic, transported to the in-store sale site, and set up in-store as in the FIGS. 2 and 3 embodiment.

Similarly, in use by a consumer, the display system 10 functions in similar fashion to and with all the advantages of the FIGS. 2 and 3 embodiment.

The foregoing is a description of a preferred embodiment of the invention which is given here by way of example only. The invention is not to be taken as limited to any of the specific features as described, but comprehends all such variations thereof as come within the scope of the appended claims.

I claim:

1. A stack display system, for use in association with a multiplicity of similar, rigid products having tops and bottoms, the stack display packaging system comprising:

a support platform means, defining a front, back and sides of the display;

a lower support panel, supported by said support platform means product bottom receiving recesses formed in said lower support panel adapted to receive and support bottoms of said products in a predetermined relationship to each other;

a plurality of products the bottoms of which are received in said product bottom receiving recesses;

an upper support panel adapted to support tops of said products;

product top receiving recesses formed in said upper support panel adapted to receive the tops of said products;

a cushion pad located above said upper support panel and overlying said tops of said products;

said lower support panel products, upper support panel, and cushion pad, forming a first layer of said display system;

at least one further layer of said display system including a further lower support panel having product bottom recesses, supported on said upper support panel with said cushion pad sandwiched therebetween, and a further plurality of products in said product bottom recesses, and a further upper support panel having product top receiving means receiving the tops of said products and a further cushion pad located above said further upper support panel, and, enclosure means around the back and at least part of the sides of the layers, extending vertically from the lowermost lower support means.

2. A stack display system as claimed in claim 1 including a cover adapted to co-operate with the uppermost upper support panel to cover the tops of said bottles.

3. A stack display system as claimed in claim 2 includng an information panel removably fastenable to the top of said enclosure means.

4. A stack display system as claimed in claim 3 wherein said information panel comprises a flexible panel defining a lower edge and two essentially vertical slits extending therefrom, the slits being engageable with the enclosure means whereby the panel may be supported by the enclosure.

5. A stack display system as claimed in claim 4 wherein the pallet is made from a plastic material and the base box, the bottom inserts, the top overlays, the cushioning pads, the enclosure means and the information panel are made from cardboard.

6. A stack display system as claimed in claim 5 wherein the information panel is loosely placed on top of the cover and including display securing means for holding the pallet, base box, layers, cover, information panel and enclosure together.

7. A stack display system as claimed in claim 6 wherein the display securing means comprises shrink wrapped plastic surrounding the pallet, base box, layers, cover, panel and enclosure.

8. A stack display system, for use in association with a multiplicity of similar, rigid products having tops and bottoms, the stack display packaging system comprising:

a support platform means, defining a front, back and sides of the display;

a plurality of integral one-piece molded trays, having top and bottom surfaces and defining product bottom receiving recesses in said top surfaces and product top receiving recesses defined in said bottom surfaces internally of the product bottom receiving recesses, and cushion pad means formed integrally in one piece with each said tray and separating said top receiving recesses from said bottom receiving recesses;

a plurality of products the bottoms of which are received in said product bottom receiving recesses of a lower said tray, and the tops of which are received in said product top receiving recesses formed in an upper said tray, and, enclosure means around the back and at least part of the sides of said trays and products, extending vertically therearound.

9. A stack display system as claimed in claim 8 wherein said support tray includes generally vertical sides.

10. A stack display system as claimed in claim 8 wherein a product bottom receiving recess includes an essentially horizontal internal ledge therein whereby the bottom of an upper product may be supported on the ledge.

11. A stack display system as claimed in claim 10 wherein a product top receiving recess extends sufficiently far from the bottom surface of the bottom recess whereby the bottom of the upper product may be supported both by the ledge and the top recess walls.

12. A stack display system as claimed in claim 11 wherein the support platform means defines a pallet having a lip extending essentially vertically around the perimeter thereof and wherein the lowermost integral molded tray and said enclosure means are adapted to fit within said lip.

13. A stack display system as claimed in claim 12 wherein the products are bottles in which may be contained a saleable commodity.

14. A stack display system as claimed in claim 13 including an information panel removably fastenable to the top of the enclosure means.

15. A stack display system as claimed in claim 14 including an information panel comprising a flexible panel defining a lower edge and two essentially vertical slits extending therefrom, the slits being engageable with the enclosure means whereby the panel may be supported by the enclosure.

16. A stack display system as claimed in claim 15 wherein channels are defined in said molded trays between adjacent said bottom receiving recesses and between said bottom receiving recesses adjacent the sides of said tray and wherein said trays are made from a plastic material.

17. A stack display system as claimed in claim 15 wherein the display securing means comprises shrink wrapped plastic surrounding the pallet, layers, cover, panel and enclosure.

18. A stack display system as claimed in claim 1 including an open-faced base box supported by said support platform means, and having an open face and side walls directed upwardly, and said lower support panel having side walls defining an open-faced box, and the open face of which is directed downwardly and nesting within said base box, and wherein said enclosure means is received in and extends vertically from said base box.

19. A stack display system as claimed in claim 18 wherein each upper support panel has side walls defining an open-faced box, the open face of which is directed directed upwardly, and wherein each further lower support panel is nestable with said upper support panel.

20. A stack display system as claimed in claim 19 wherein said support platform means defines a pallet having a lip extending essentially vertically around the perimeter of the pallet and wherein said base box is adapted to fit within said lip.

21. A stack display system as claimed in claim 19 wherein the products are bottles, and wherein the product bottom receiving recesses and the product top receiving recesses register with one another, whereby the bottles in an upper layer are supported axially and directly by the bottles in an adjacent lower layer.

* * * * *